US005190154A

United States Patent [19]

Reusch

[11] Patent Number: 5,190,154

[45] Date of Patent: Mar. 2, 1993

[54] BOX FOR RECEIVING SCREWDRIVER BITS

[75] Inventor: Andreas Reusch, Remscheid, Fed. Rep. of Germany

[73] Assignee: Wera Werk Hermann Werner GmbH & Co. KG, Wuppertal, Fed. Rep. of Germany

[21] Appl. No.: 759,414

[22] Filed: Sep. 13, 1991

[30] Foreign Application Priority Data

Sep. 20, 1990 [DE] Fed. Rep. of Germany ... 9013289[U]

[51] Int. Cl.[5] ..... B65D 85/20

[52] U.S. Cl. ..... 206/375; 220/522

[58] Field of Search ..... 206/349, 369–379; 220/212, 337, 338, 521, 522

[56] References Cited

U.S. PATENT DOCUMENTS

| | | | |
|---|---|---|---|
| 1,365,682 | 1/1921 | Greist et al. | 206/373 |
| 2,487,174 | 11/1949 | Petre | 206/375 |
| 2,522,213 | 9/1950 | Doniger | 206/375 |
| 2,775,349 | 12/1956 | Smith | 206/379 |
| 2,792,934 | 5/1957 | Rocchetti . | |
| 2,792,935 | 5/1957 | Rocchetti | 206/379 |
| 2,880,857 | 4/1959 | Parsons et al. . | |
| 3,269,529 | 8/1966 | Hume | 206/373 |
| 3,578,153 | 5/1971 | Olson | 206/379 |
| 4,150,746 | 4/1979 | Buglione | 206/378 |
| 4,598,822 | 7/1986 | Hemmings | 206/379 |
| 4,865,194 | 9/1989 | Decarie | 206/378 |

FOREIGN PATENT DOCUMENTS

| | | | |
|---|---|---|---|
| 0695174 | 9/1964 | Canada | 206/379 |
| 0946336 | 4/1974 | Canada | 206/373 |
| 8515834 | 11/1986 | Fed. Rep. of Germany . | |
| 8801835 | 5/1988 | Fed. Rep. of Germany . | |
| 8816175 | 11/1989 | Fed. Rep. of Germany . | |
| 8913207 | 2/1990 | Fed. Rep. of Germany . | |
| 8914050 | 3/1990 | Fed. Rep. of Germany . | |
| 1329755 | 5/1963 | France . | |
| 0992333 | 2/1983 | U.S.S.R. | 206/379 |

*Primary Examiner*—Jimmy G. Foster
*Attorney, Agent, or Firm*—Martin A. Farber

[57] ABSTRACT

A box (1) for receiving screwdriver bits (27) and the corresponding chuck (14, 39) in a compartment (13) which extends in the longitudinal direction of the box (1) and transverse to which there are arranged in a row a plurality of screwdriver bits (27). In order to obtain a solution which is particularly favorable in use, the compartment (13) extends along the closure side of the bottom part (2) of a box half which is closed by a hinged lid and the bits (27) are seated in a ledge (24) extending in the hinge shaft (28) on the hinge side of the hinged lid in such a manner that the tips of the screwdriver bits (27) which tilt upon the opening of the hinged lid (3) out of the position parallel to the bottom into an upright position, are secured in the position parallel to the bottom by the inner compartment wall (12) against falling out of their insertion openings (26).

7 Claims, 5 Drawing Sheets

FIG. 4
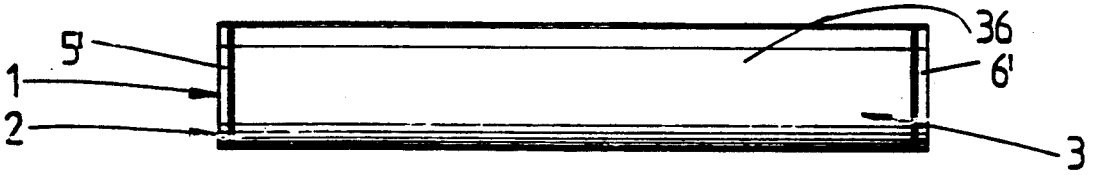
FIG. 3
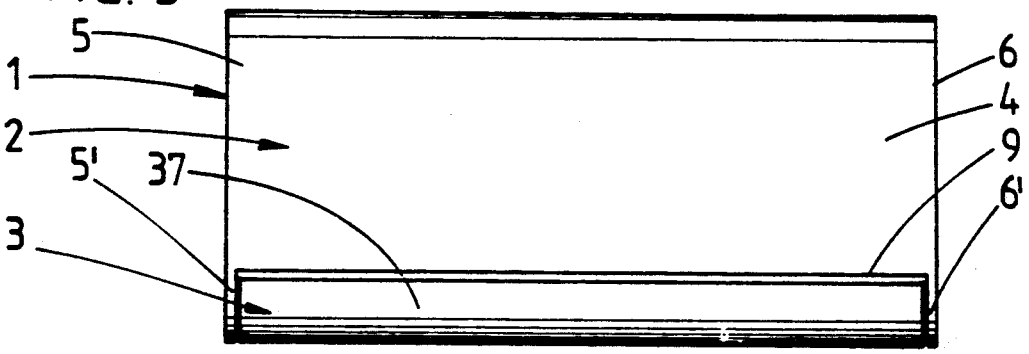
FIG. 2
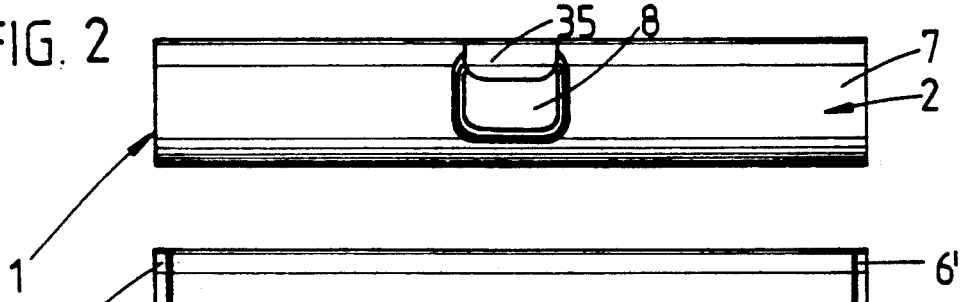
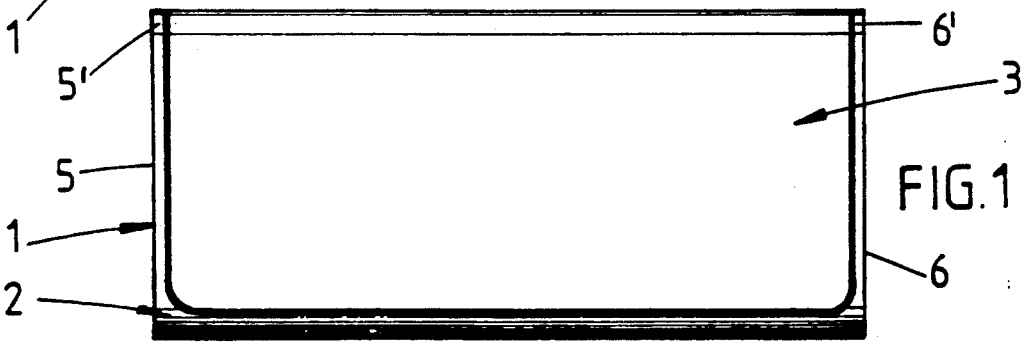
FIG. 1
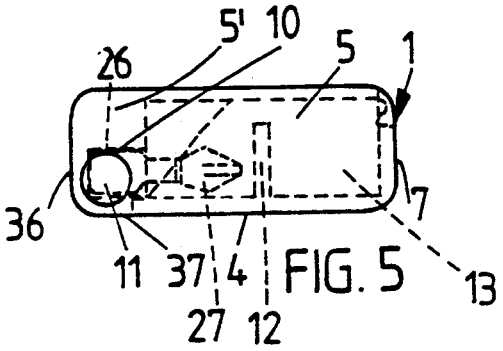
FIG. 5
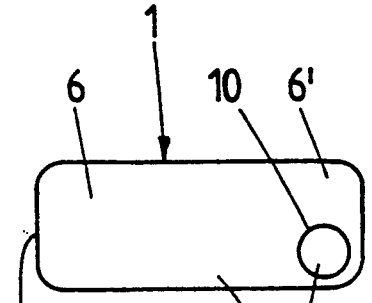
FIG. 6

BOX FOR RECEIVING SCREWDRIVER BITS

FIELD AND BACKGROUND OF THE INVENTION

The present invention relates to a box for receiving screwdriver bits with the corresponding chuck which is arranged in a compartment extending in the longitudinal direction of the box and transverse to which a plurality of screwdriver bits which are held in insertion openings are arranged in a row alongside each other.

Such a box is known from Federal Republic of Germany Utility Model 8 801 835 in which the box housing receives a bit which is displaceable along the longitudinal axis of the box. This bit has, on the one side, stop projections to limit the outward displacement of the bit and, on the other side, a handle which, in the closed position of the box, serves as closure cap of the narrow side of the box. The bit has receivers, arranged on the side of its longitudinal axis and parallel to it, for a plurality of screwdriver bits and a holder for a corresponding chuck. The individual receivers for the screwdriver bits are aligned transverse to the longitudinal axis and are developed as spring holders to receive the screwdriver bits clamped therein. On the side of the longitudinal axis opposite said receivers, the bit has a chuck holder which consists mainly of a mandrel and a clamping holder. The chuck is held on one side by the mandrel which extends into the screwdriver bit insertion opening and at the other side by the clamping holder in the region of the hexagon of the chuck. This shape of development has disadvantages with respect to the use of the box. Use with one hand is possible only with difficulty due to the spring-loaded clamping holders of the screwdriver bits and the chuck. Furthermore, it is only possible to use this box as a tabletop box to a limited extent since the requirements for a tabletop box, for instance, one-hand operation, stability, etc. are not assured.

SUMMARY OF THE INVENTION

The object of the present invention is to develop a box of this type for receiving screwdriver bits and the corresponding chuck in a manner which is more favorable in use.

As a result of the development of the invention there is obtained a box which is optimally developed from the standpoint of use. This is achieved in the manner that the compartment in which the chuck is arranged extends along the closure side of the bottom part of a box half which is closed by a hinged lid and the insertion openings are developed as holes in a ledge extending in the hinge axis on the hinge side of the hinged lid in such a manner that the tips of the screwdriver bits which, upon the opening of the hinged lid, swing out of a position parallel to the bottom into an upright position are secured in their position parallel to the bottom by the inner compartment wall against falling out of their insertion opening.

As a result of this development, single-handed operation is possible after opening the box. When the box is opened, the screwdriver bits are aligned almost perpendicular to the bottom of the bottom part and held in the insertion openings which are developed as holes. The bits can now be pulled out of the insertion openings with one hand without resistance. The one-handed removal is true in this case also of the chuck which lies merely loosely, i.e. without clamping, in a compartment of the bottom part. Due to the fact that both the screwdriver bits and the chuck can be removed from the box with one hand, the box can also be used as tabletop box. It thus offers a great advantage from the standpoint of handling. When the box is closed, the screwdriver bits are secured against falling out of their insertion openings by the fact that in this position they are parallel to the bottom and rest with their free ends against the inner wall of the receiving compartment for the chuck.

In another development of the object of the invention, there is at least one transverse wall of the compartment which forms a storage notch for the chuck in order to hold the free end of the chuck at a distance from the bottom of the bottom part. In this way, removal of the chuck from the compartment of the box is facilitated. The free end of the chuck extends, in this case, beyond the transverse wall of the compartment. By pressing the free end of the chuck down in the direction towards the bottom of the bottom part, the chuck swings around the pivot point in the region of the transverse wall so that the end of the chuck facing away from the transverse wall extends out of the compartment. The chuck can thus be easily removed from the box. In order to use the same box for two different chucks, two transverse walls can be arranged in the chuck compartment at different distances from the side wall of the bottom part. The box can now be used for two chucks of different size without any structural change of the box in the region of the compartment.

The storing of the chuck in the compartment of the box is optimized by a prism-like support on the bottom of the bottom part for the end of the chuck facing away from the transverse wall. The chuck is now stored in a horizontal position, parallel to the bottom of the bottom part. It is possible, also in this case, to arrange two prism-like supports at different distances from the side wall of the bottom part in order to afford the possibility, also in this case, of using the box for two chucks of different size.

Another advantage consists in the fact that the hinge pins extend integrally from the ends of the ledge which ledge, as already mentioned above, has the insertion openings for the screwdriver bits. The end regions of the ledge are connected via triangular corner walls to the bottom of the hinged lid, thus assuring greater stability of the hinged lid. Finally, there is the particular advantage that the ledge takes up the longitudinal rear wall and a strip of the bottom surface of the bottom part. The bottom of the bottom part has on the hinge side of the hinged lid a recess which extends practically over the entire length of the bottom in closed position of the box, this recess is filled by a side wall of the ledge. Another side wall of the ledge forms the longitudinal rear wall of the box. In open position, said longitudinal rear wall takes up the strip of the bottom surface in the region of the recess.

BRIEF DESCRIPTION OF THE DRAWINGS

Further advantages and details of the invention will be explained in detail below with reference to two embodiments shown in the drawing, in which:

FIG. 1 shows in top view a box in accordance with the invention for receiving screwdriver bits and the corresponding chuck, according to a first embodiment;

FIG. 2 is a front view of the box of FIG. 1.

FIG. 3 is a bottom view of the box;

FIG. 4 is a rear view of the box;

FIG. 5 is a side view;

FIG. 6 is another side view;

DETAILED DESCRIPTION OF THE PREFERRED EMBODIMENTS

Figure 7:
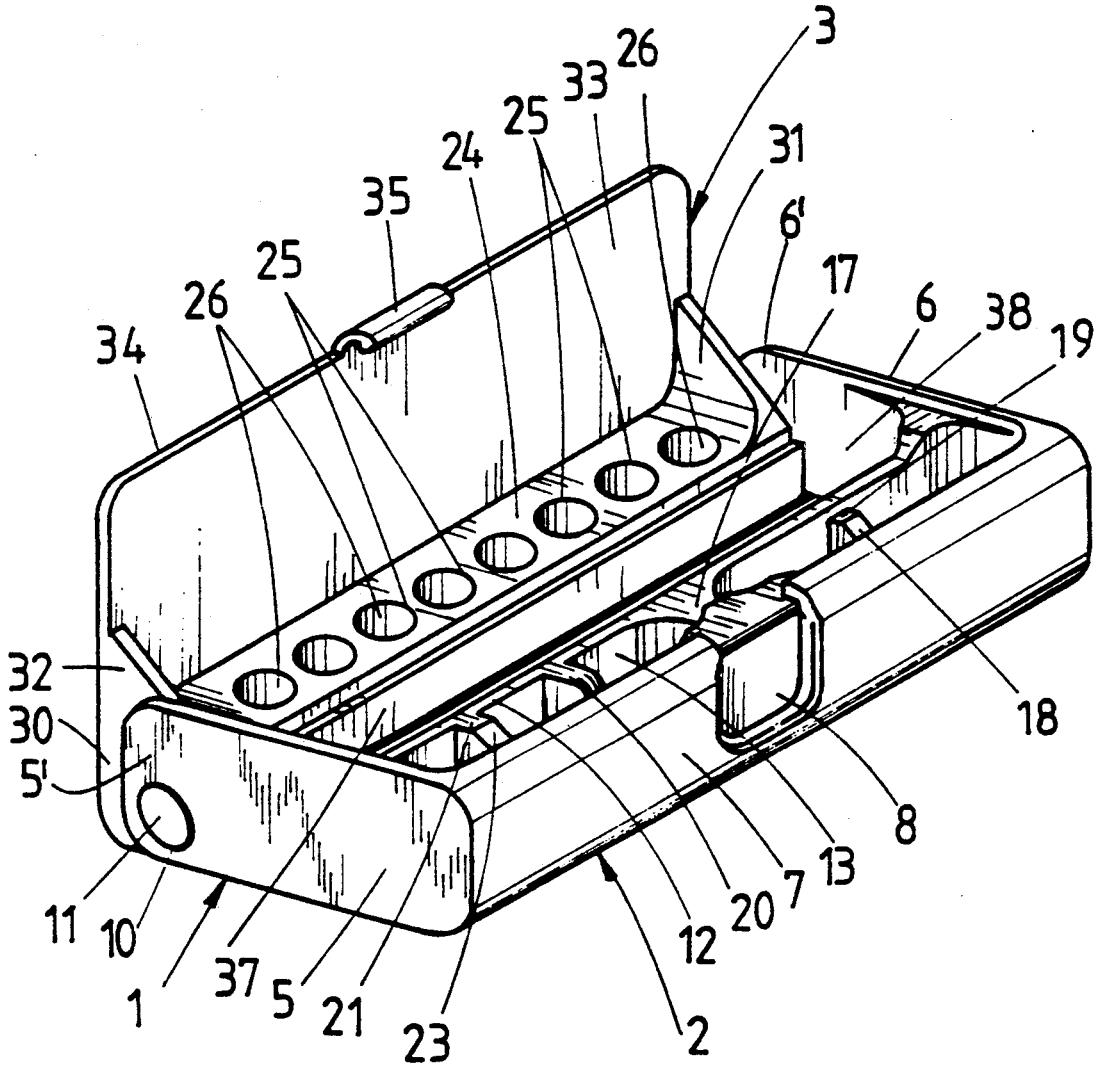
FIG. 7 shows the box open, in perspective, but without screwdriver bits and chuck.
Figure 8:
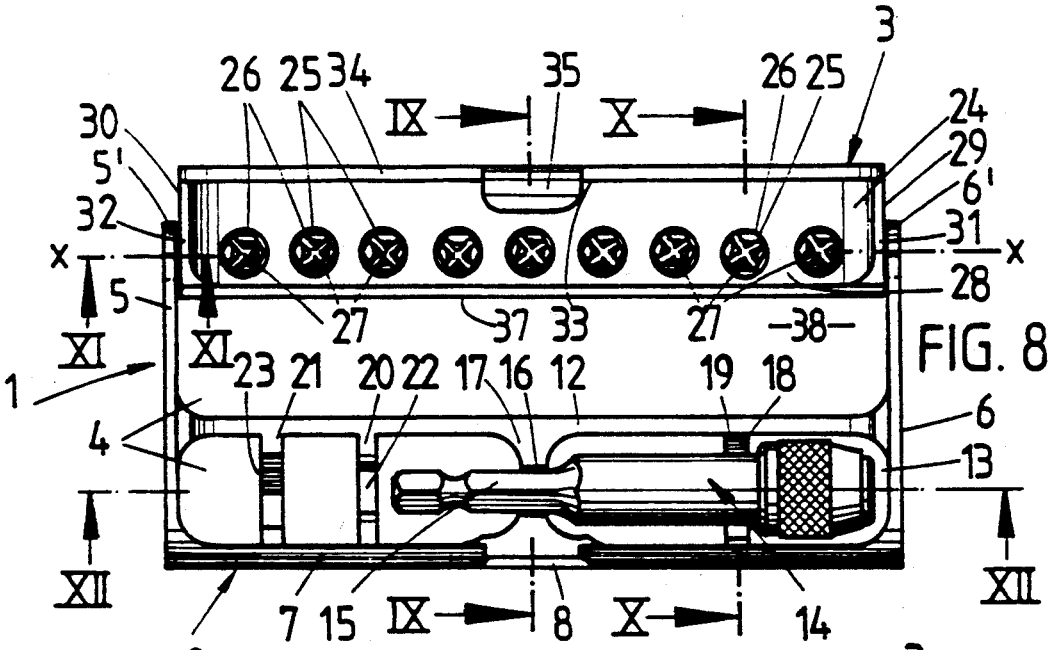
FIG. 8 is a top view of the open box with a chuck in it and a plurality of screwdriver bits held in insertion openings.

The box 1 shown consists of a bottom part 2 and a hinged lid 3.

The bottom part 2 has a bottom 4 from the narrow edges of which side walls 5, 6 extend and from one of its longitudinal sides a front wall 7. The front wail 7 has a depression 8 in its center. The length of the side walls 5 and 6 is greater than the length of the narrow side of the bottom 4. The region formed between the side wall sections 5', 6' which extend above the bottom is designated as free surface 9. In the side wall sections 5', 6' holes 10 are provided to receive the hinge pins 11 of the hinged lid 3. With the bottom 4 there is centrally associated a compartment wall 12 which extends parallel to the front wall 7 and between the inner sides of the side walls 5 and 6. The space between compartment wall 12 and front wall 7 is used as compartment 13 for receiving a chuck 14. This chuck 14 lies at one end in the region of its free chuck end 15, i.e. its hexagon, in a storage notch 16 in a transverse wall 17 and at the other end in the region of the end opposite the free end 15 of the chuck on a prism-like support 18 of a partition wall 19. The storage notch 16 and the prism-like support 18 are so aligned that the longitudinal axis of the chuck 14 extends parallel to the front wall 7, i.e. in the longitudinal direction of the box 1 and parallel to the bottom 4 of the bottom part 2. The transverse wall 17 is, in this connection, arranged in the center of the compartment 13 between the compartment wall 12 and the front wail 7. On the side of the transverse wall 17 opposite the partition 19, there is, furthermore, provided a second transverse wall 20 and a partition 21. Both the transverse wall 20 and the partition 21 extend, in this case, also between the compartment wall 12 and the front wall 7, the transverse wall 20 having a storage notch 22 and the partition 2 a prism-like support 23. The transverse wall 20 is so arranged that it is spaced from the free end 15 of the chuck 14. This double development of transverse wall and partition serves to make it possible to equip the box 1 with two different chucks without previously changing the receiving means for the chuck in the region of the compartment 13.

The hinged lid 3 has a ledge 24. This ledge 24 is of substantially rectangular shape and has on its broader, inner broad side equally spaced insertion openings 26 developed as holes 25. These insertion openings 26 extend from the surface of the inner broad side of the ledge 24 almost to the rear broad side, while maintaining a residual wall thickness. These insertion openings 26 receive screwdriver bits 27 in a manner protected against tilting. The ledge 24, furthermore, serves as hinge axis 28 for which purpose the above-mentioned hinge pins 11 extend integrally from the ledge 24 at its ends 29, 30. In the region of these front sides 29, 30 triangular corner walls 31, 32 extend from the ledge 24, said corner walls being connected to the hinged lid bottom 33 of a lid 34. At its free end, the lid 34 has a lock 35 in its center.

When the box 1 is closed, the lock 35 engages behind a corresponding bead in the region of the depression 8 of the front wall 7. The depression 8 serves, in this connection, for better handling upon the opening of the box 1. The lid 34 lies, in this case, between the side walls 5, 6 and the front wall 7. The broad side of the ledge 24 opposite the insertion openings 26 forms the longitudinal rear wall 36. The narrow side 37 of the ledge 24 opposite the lid 34 forms the extension of the bottom 4 of the bottom part 2 in the region of the free surface 9. The screwdriver bits 27 are held in the insertion openings 26 and are in a position parallel to the bottom, the tips of the screwdriver bits 27 lying in front of and at a small distance away from the side of the compartment wall 12 facing them. They are, thus, secured against falling out of their insertion openings 26.

In order to open the box 1, the hinged lid 3 is swung by about 90° around the axis x formed by the hinge pins 11 and the ledge 24. The screwdriver bits 27 previously lying in a receiving compartment 38 formed by the ledge 24, sidewalls 5, 6 and compartment wall 12, are now in an almost vertical position. The narrow side 37 of the ledge 24 opposite the lid 34 now forms the end of the receiving compartment 38. The longitudinal rear wall 36 of the hinged lid 3 takes up the extension of the bottom surface of the bottom part 2, in which connection, due to the fact that the height of the longitudinal rear wall 36 is greater than the depth of the free surface 9 of the bottom 4, one part of the longitudinal rear wall 36 fills up the free surface 9 and the other part forms an extension of the bottom 4.

Figure 12:
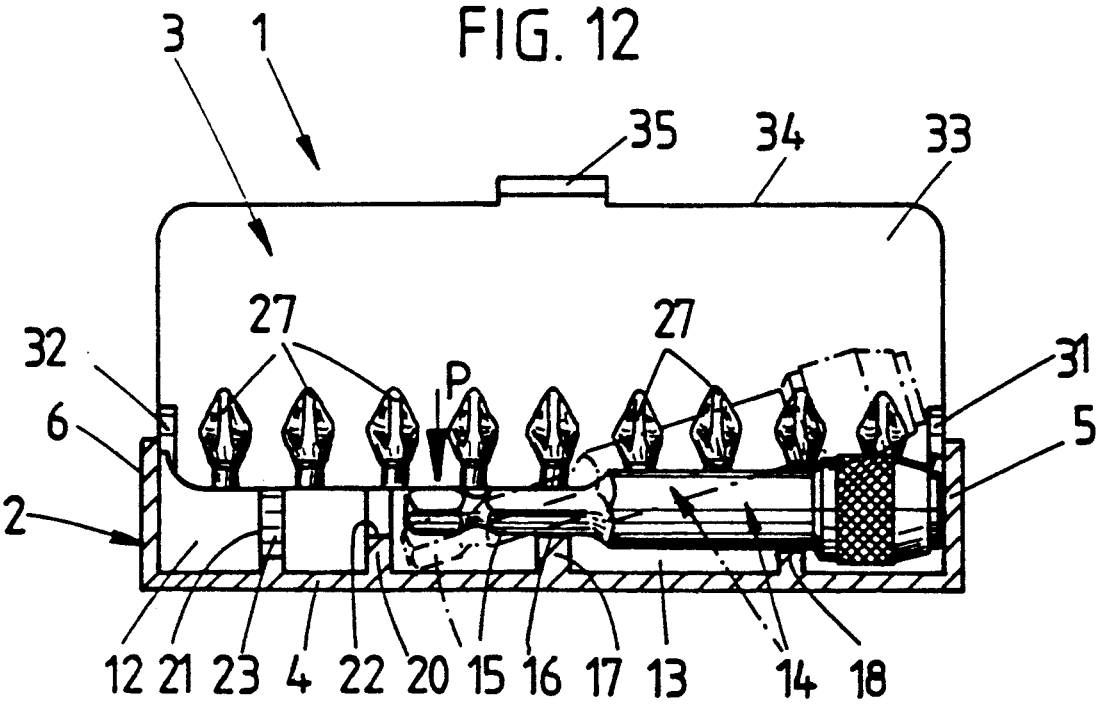
FIG. 12 is a longitudinal section along the line XII—XII of FIG. 8, the removal position of the chuck being shown in dash-dot line.
Figure 13:
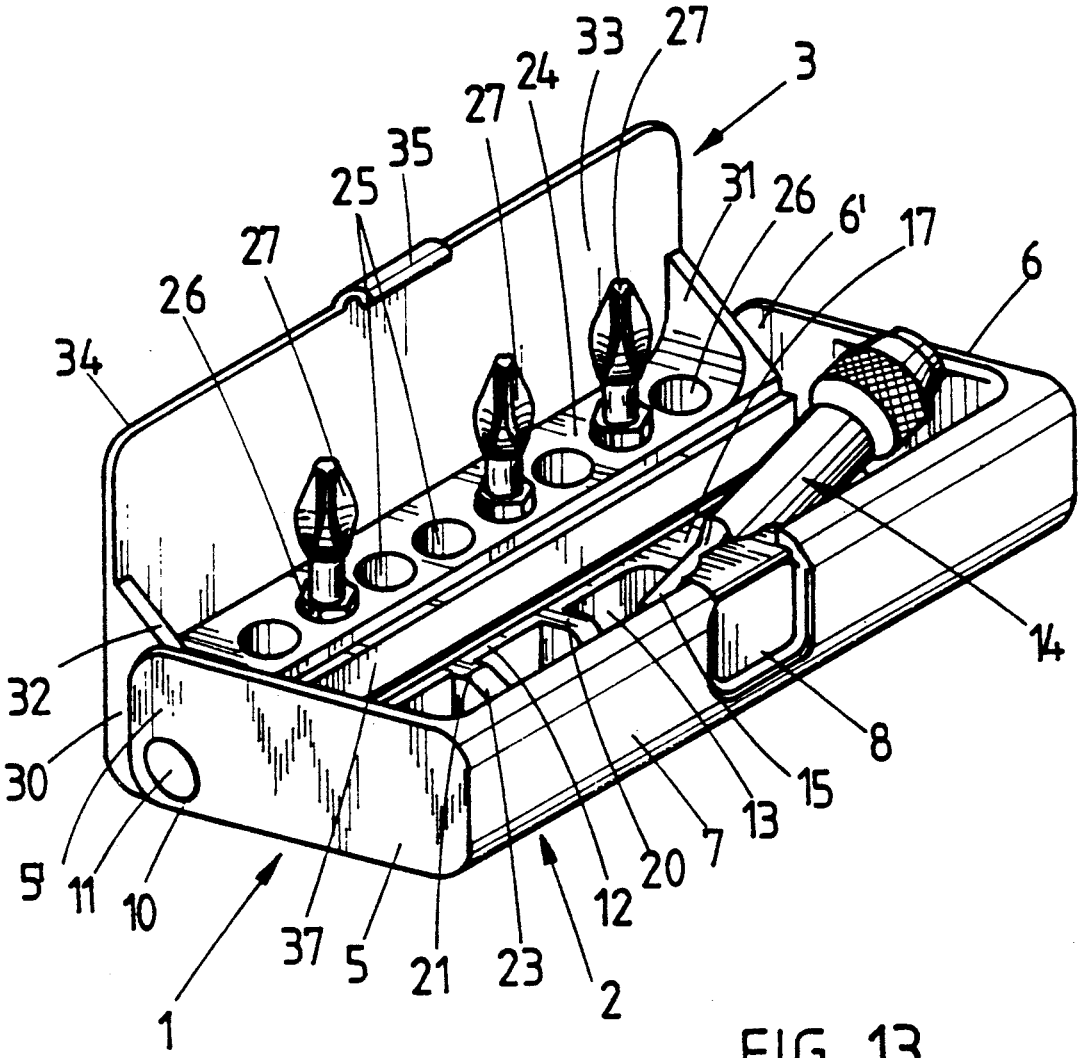
FIG. 13 shows the open box in perspective view according to FIG. 7, but with the chuck pressed down and several screwdriver bits held in the insertion openings.

The chuck 14 is removed in very simple manner. By pressing the free end 15 of the chuck down in the direction of the arrow P and towards the bottom 4, the end opposite the free chuck 15 is displaced upward around the storage notch 16 which forms a pivot point (see FIG. 12 and FIG. 13). The end of the chuck 14 extending out of the bottom part 2 can now be readily grasped and the chuck 14 be removed.

Figure 14:
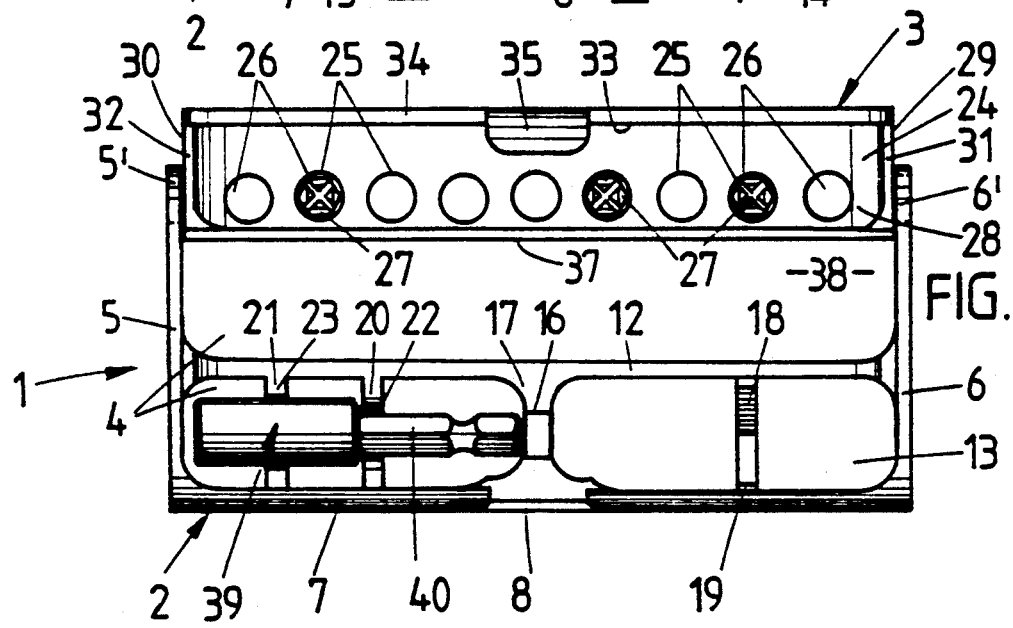
FIG. 14 is a top view of the open box in accordance with a second embodiment, another chuck being inserted in this case.
Figure 9:
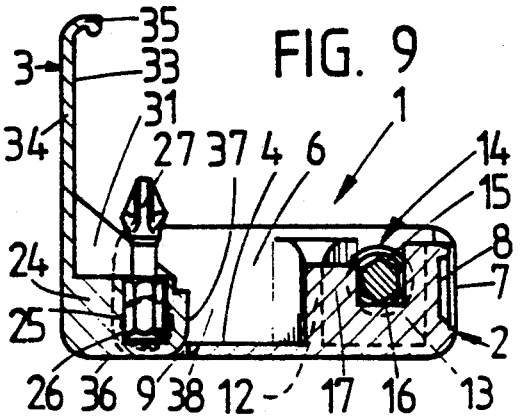
FIG. 9 is a cross section along the line IX—I of FIG. 8.
Figure 10:
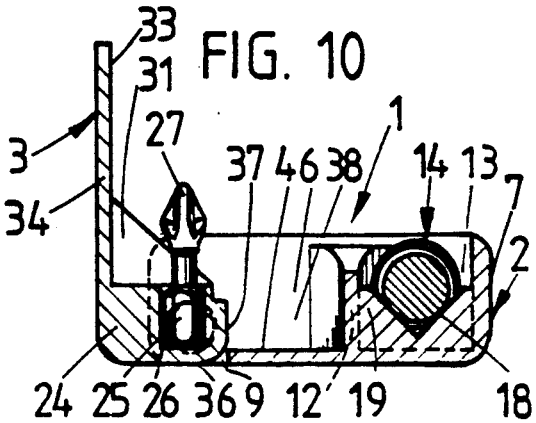
FIG. 10 is a section along the line X—X of FIG. 8.
Figure 11:
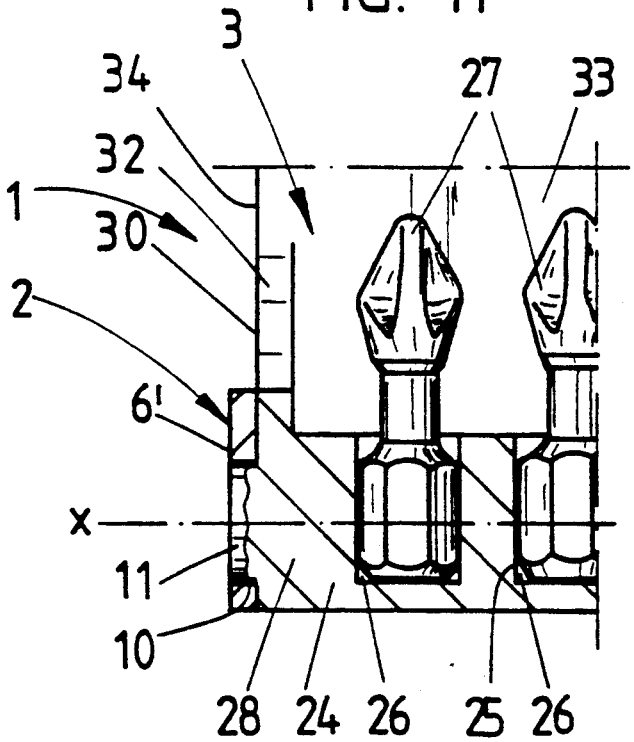
FIG. 11 is a section along the line XI—XI of FIG. 8.

In the embodiment shown in FIG. 14, the chuck 14 has merely been replaced by a chuck 39. In this case, the box 1 is the same one as in the above-described first embodiment, there being the advantage here of the double arrangement of transverse wall and partition in the compartment 13. The chuck 39, which is smaller than the chuck 14, lies with its hexagon part in the region of the transverse wall 20 in the storage notch 22. In the region opposite the hexagon part, it is further supported by the prism-like support 23 of the partition. The free chuck end 40 lies also, in this case, in front of and spaced from the transverse wall 17. By simply depressing this free chuck end 14 in the direction towards the bottom 4, this chuck 39 is also displaced around the storage notch 22 which forms a pivot point, the end of the chuck 39 opposite the free chuck end 14 swinging out of the bottom part 2 for removal.

It is of particular advantage in both embodiments that the removal of screwdriver bits 27 or of a chuck 14, 39 can be effected with one hand when the box 1 is open Furthermore, the box 1 is of high stability so that the box 1 described also satisfies the requirements for a table-top box.

I claim:

1. A box for receiving screwdriver bits and a chuck operative with the bits, the box comprising:

a compartment which extends in a longitudinal direction of the box and is configured to receive the chuck;

a row of insertion openings arranged parallel to the compartment and configured for receiving the bits;

a bottom part having said compartment, and a closure lid hinged via a hinge to the bottom part along a back side of the box, there being a closure side of the bottom part opposite said back side of the box;

wherein said compartment extends along the closure side of said bottom part of the box;

said lid includes a ledge facing said bottom part of the box and extending parallel to and adjacent said hinge; and said insertion openings are developed as holes in said ledge and direct tips of the screwdriver bits away from said hinge to provide for a tilting of the box, upon a pivoting of the hinged lid during an opening of the box, from a position parallel to a bottom of the box into an upright position, the tips being secured in the insertion openings in positions parallel to the bottom of the box by an inner wall of said compartment against falling out of their insertion openings.

2. A box, according to claim 1, wherein said compartment has at least one transverse wall which forms a storage notch for the chuck and serves to hold a free end of the chuck in a position spaced apart from the bottom of the box.

3. A box, according to claim 2, wherein said bottom part of the box comprises a first side wall and a second side wall disposed on opposite sides of said bottom part; and said box further comprises a second transverse wall, said one transverse wall and said second transverse wall being at different distances from respective ones of said side walls of the bottom part.

4. A box, according to claim 2, further comprising a prism-like support disposed in a bottom of said compartment for the chuck end.

5. A box, according to claim 1, wherein a pin of said hinge extends integrally from ends of said ledge.

6. A box, according to claim 1, further comprising triangular corner walls;

wherein end regions of the ledge are connected via said triangular corner walls to a bottom side of said lid.

7. A box, according to claim 1, wherein said ledge occupies a longitudinal rear wall of the box and a strip of the bottom of the box upon a closure of the box.

* * * * *